US010081020B2

(12) United States Patent
Athens et al.

(10) Patent No.: US 10,081,020 B2
(45) Date of Patent: Sep. 25, 2018

(54) HYDROTHERMAL METHOD FOR MANUFACTURING FILTERED SILVER NANOWIRES

(71) Applicant: Dow Global Technologies LLC, Midland, MI (US)

(72) Inventors: George L. Athens, Freeland, MI (US); Raymond M. Collins, Midland, MI (US); William R. Bauer, Midland, MI (US); Patrick T. McGough, Midland, MI (US); Janet M. Goss, Saginaw, MI (US); George J. Frycek, Midland, MI (US); Wei Wang, Midland, MI (US); Jonathan D. Lunn, Pearland, TX (US); Robin P. Ziebarth, Midland, MI (US); Richard A. Patyk, Frankenmuth, MI (US)

(73) Assignee: Dow Global Technologies LLC, Midland, MI (US)

( * ) Notice: Subject to any disclaimer, the term of this patent is extended or adjusted under 35 U.S.C. 154(b) by 191 days.

(21) Appl. No.: 15/158,297

(22) Filed: May 18, 2016

(65) Prior Publication Data

US 2016/0361724 A1 Dec. 15, 2016

Related U.S. Application Data

(60) Provisional application No. 62/174,677, filed on Jun. 12, 2015.

(51) Int. Cl.

| | |
|---|---|
| ***B22F 9/24*** | (2006.01) |
| ***B03B 5/66*** | (2006.01) |
| ***C22B 3/00*** | (2006.01) |
| ***B22F 1/00*** | (2006.01) |
| *B22F 3/00* | (2006.01) |

(52) U.S. Cl.

CPC ..... *B03B 5/66* (2013.01); *B22F 1/0025* (2013.01); *B22F 9/24* (2013.01); *C22B 11/04* (2013.01); *B22F 3/003* (2013.01)

(58) Field of Classification Search

None

See application file for complete search history.

(56) References Cited

U.S. PATENT DOCUMENTS

| | | | |
|---|---|---|---|
| 5,000,848 | A | 3/1991 | Hodgins et al. |
| 5,143,630 | A | 9/1992 | Rolchigo |
| 5,254,250 | A | 10/1993 | Rolchigo et al. |
| 5,944,998 | A | 8/1999 | Rolchigo et al. |
| 5,993,674 | A | 11/1999 | Rolchigo et al. |

(Continued)

FOREIGN PATENT DOCUMENTS

| | | |
|---|---|---|
| CN | 101934378 | 1/2011 |
| CN | 103894624 | 7/2014 |

(Continued)

OTHER PUBLICATIONS

Millipore Corporation, Protein Concentration and Diafiltration by Tangential Flow Filtration, Technical Brief (2003).

(Continued)

*Primary Examiner* — George Wyszomierski

(74) *Attorney, Agent, or Firm* — Thomas S. Deibert

(57) ABSTRACT

A method for manufacturing filtered high aspect ratio silver nanowires is provided, wherein a total glycol concentration is <0.001 wt % at all times.

10 Claims, 4 Drawing Sheets

(56) References Cited

U.S. PATENT DOCUMENTS

| | | | |
|---|---|---|---|
| 6,027,656 | A | 2/2000 | Henttonen et al. |
| 6,478,969 | B2 | 11/2002 | Brantley et al. |
| 7,585,349 | B2 | 9/2009 | Xia et al. |
| 7,749,299 | B2 | 7/2010 | Vanheusden et al. |
| 7,922,787 | B2 | 4/2011 | Want et al. |
| 8,314,191 | B2 | 11/2012 | Collins et al. |
| 8,541,098 | B2 | 9/2013 | Allemand |
| 8,648,525 | B2 | 2/2014 | Chiba et al. |
| 8,727,112 | B2 | 5/2014 | Young et al. |
| 8,876,937 | B2 | 11/2014 | Peng et al. |
| 9,034,075 | B2 | 5/2015 | Lunn et al. |
| 2004/0256318 | A1 | 12/2004 | Lida et al. |
| 2007/0045589 | A1 | 3/2007 | Ittel et al. |
| 2008/0032047 | A1 | 2/2008 | Parashar et al. |
| 2009/0242231 | A1 | 10/2009 | Miyagishima et al. |
| 2009/0311530 | A1 | 12/2009 | Hirai et al. |
| 2009/0321364 | A1 | 12/2009 | Spaid et al. |
| 2010/0078197 | A1 | 4/2010 | Miyagishima et al. |
| 2010/0242679 | A1 | 9/2010 | Yu et al. |
| 2013/0160608 | A1 | 6/2013 | Nusko et al. |
| 2013/0255444 | A1 | 10/2013 | Kawaguchi |
| 2013/0334075 | A1 | 12/2013 | Young et al. |
| 2014/0203223 | A1 | 7/2014 | Ikada et al. |
| 2014/0231282 | A1 | 8/2014 | Young et al. |
| 2015/0125592 | A1 | 5/2015 | Arai et al. |
| 2016/0014393 | A1 | 1/2016 | Kadambi et al. |
| 2016/0114394 | A1 | 4/2016 | McGough et al. |
| 2016/0114396 | A1 | 4/2016 | Wang et al. |
| 2016/0114397 | A1 | 4/2016 | Ziebarth et al. |
| 2016/0361723 | A1* | 12/2016 | Collins ..... B03B 5/66 |

FOREIGN PATENT DOCUMENTS

| | | |
|---|---|---|
| CN | 104511596 | 4/2015 |
| KR | 2013072956 | 7/2013 |
| TW | 201024002 | 7/2010 |
| WO | 2003032084 | 4/2003 |

OTHER PUBLICATIONS

Jradel, et al., Cross-Flow Purification of Nanowires, Angewandte Chemie International Eddition, 50, pp. 3412-3416 (2011).

Korte, et al., Rapid synthesis of silver nanowires through a CuCl- or CuCl2- mediated polyol process, Journal Of Materials Chemistry 18, pp. 437-441, (2007).

He, et al., Synthesis and characterization of silver nanowires with zigzag morphology in N,N dimethylformamide, Journal of Solid State Chemistry 180, pp. 2262-2267 (2007).

Zhao, et al., Synthesis and formation mechanism of silver nanowires by a templateless and seedless method, Chemistry Letters, vol. 34, No. 1, pp. 30-31 (2005).

Tang, et al., One-dimensional assemblies of nanoparticles: preparation, properties, and promise, Acvanced Materials 17, No. 8, pp. 951-962 (2005).

Xiong, et al., Formation of silver nanowires through a sandwiched reduction process, Acvanced Materials 15, No. 5, pp. 405-408 (2003).

Sarkar, et al., Effective chemical route for the synthesis of silver nanostructures in formamide, Res. Chem. Intermed 35, pp. 71-78 (2009).

Pastoriza-Santos, et al., Self-assembly of silver particle monolayers on glass from Ag+ solutions in DMG, J. of Colloid and Interface Science 221, pp. 236-241 (2000).

Mdluli, et al., An improved N,N-dimethylformamide and polyvinyl pyrrolidone approach for the synthesis of long silver nanowires, Journal of Alloys and Compounds 469, No. 5, pp. 519-522 (2009).

Walther, et al., Structure-tunable bidirectional hybrid nanowires via multicompartment cylinders, Nano Letters vol. 9, No. 5, pp. 2026-2030 (2009).

Pastoriza-Santos, et al., N,N-Dimethylformamide as a reaction medium for metal nanoparticle synthesis, Advanced Functional Materials 19, pp. 679-688 (2009).

Sun, et al., Polyol synthesis of uniform silver nanowires: a plausible growth mechanism and the supporting evidence, Nano Letters, vol. 3, No. 7, pp. 955-960 (2003).

Wiley, et al., Polyol synthesis of silver nanostructures: control of product morphology with Fe(II) or Fe(III) species, Langmuir, vol. 21, No. 18, pp. 8077-8080 (2005).

Ducamp-Sanguese, et al., Synthesis and characterization of fine monodisperse silver particles of uniform shape 100, pp. 272-280 (1992).

Wiley, et al., Synthesis of silver nanostructures with controlled shapes and properties 40, pp. 1067-1076 (2007).

Giersig, et al., Evidence of an aggregate mechanism during the formation of silver nanowires in N,N-dimethylformamide, J. Mater. Chem. 14, pp. 607-610 (2004).

Zhao, et al., Low temperature synthesis and growth mechanism of silver nanowires by a soft-chemistry method, Acta Chimica Sinica, vol. 61, No. 10, pp. 1671-1674 (2003).

Pallavicine, et al., Self-assembled monolayers of silver nanoparticles firmly grafted on glass surfaces: low Ag+ release for an efficient antibacterial activity, J. of Colloid and Interface Science 350, pp. 110-116 (2010).

Pastoriza-Santos, et al., Formation and Stabilization of Silver Nanoparticles through Reduction by N,N-Dimethylformamide, Langmuir 15, pp. 948-951 (1999).

Copending U.S. Appl. No. 15/158,257.

Search report from corresponding Chinese 201610397639.7 application, dated Sep. 20, 2017.

* cited by examiner

HYDROTHERMAL METHOD FOR MANUFACTURING FILTERED SILVER NANOWIRES

This application claims priority to U.S. Provisional Application No. 62/174,677, filed on Jun. 12, 2015 which is incorporated herein by reference in its entirety.

The present invention relates generally to the field of manufacture of filtered silver nanowires. In particular, the present invention is directed to a method for manufacturing filtered silver nanowires exhibiting a high aspect ratio for use in various applications.

Films that exhibit a high conductivity with a high transparency are of great value for use as electrodes or coatings in a wide range of electronic applications, including, for example, touch screen displays and photovoltaic cells. Current technology for these applications involves the use of a tin doped indium oxide (ITO) containing films that are deposited through physical vapor deposition methods. The high capital cost of physical vapor deposition processes has led to the desire to find alternative transparent conductive materials and coating approaches. The use of silver nanowires dispersed as a percolating network has emerged as a promising alternative to ITO containing films. The use of silver nanowires potentially offer the advantage of being processable using roll to roll techniques. Hence, silver nanowires offer the advantage of low cost manufacturing with the potential of providing higher transparency and conductivity than conventional ITO containing films.

The "polyol process" has been disclosed for the manufacture of silver nanostructures. The polyol process uses ethylene glycol (or an alternative glycol) as both a solvent and a reducing agent in the production of silver nanowires. The use of glycols; however, has several inherent disadvantages. Specifically, using glycol as both the reducing agent and the solvent results in a decrease in control over the reaction as the principal reducing agent species (glycolaldehyde) is produced in situ and its presence and concentration are dependent on the extent of exposure to oxygen. Also, the use of glycol introduces the potential for the formation of combustible glycol/air mixtures in the headspace of the reactor used to produce the silver nanowires. Finally, the use of large volumes of glycol create disposal concerns, increasing the cost of commercializing such operations.

One alternative approach to the polyol process for manufacturing silver nanowires has been disclosed by Miyagishima, et al. in United States Patent Application Publication No. 20100078197. Miyagishima, et al. disclose a method for producing metal nanowires, comprising: adding a solution of a metal complex to a water solvent containing at least a halide and a reducing agent, and heating a resultant mixture at 150° C. or lower, wherein the metal nanowires comprise metal nanowires having a diameter of 50 nm or less and a major axis length of 5 μm or more in an amount of 50% by mass or more in terms of metal amount with respect to total metal particles.

Another alternative approach to the polyol process for manufacturing silver nanowires has been disclosed by Lunn, et al. in United States Patent Application Publication No. 20130283974. Lunn, et al. disclose a process for manufacturing filtered high aspect ratio silver nanowires, wherein the recovered silver nanowires exhibit an average diameter of 25 to 80 nm and an average length of 10 to 100 μm; and, wherein the total glycol concentration is <0.001 wt % at all times during the process.

Notwithstanding, while producing desirable, high aspect ratio silver nanowires, the manufacturing method described by Lunn, et al. also results in the formation of silver nanowire populations having a broad diameter distribution which can result in non-uniformity in the electrical properties of films produced.

Accordingly, there remains a need for alternative silver nanowire manufacturing methods. In particular, for methods of manufacturing filtered silver nanowires that do not involve the use of glycol, wherein the filtered silver nanowires produced exhibit a low silver nanoparticle content.

The present invention provides a method for manufacturing filtered high aspect ratio silver nanowires, comprising: providing a container; providing an initial volume of water; providing an initial reducing sugar; providing an initial polyvinyl pyrrolidone (PVP), wherein the initial polyvinyl pyrrolidone (PVP) provided is dividable into a first part of the initial polyvinyl pyrrolidone (PVP) and a second part of the initial polyvinyl pyrrolidone (PVP); providing an initial source of copper (II) ions; providing an initial source of halide ions; providing an initial source of silver ions, wherein the initial source of silver ions provided is dividable into a first portion of the initial source of silver ions and a second portion of the initial source of silver ions; adding the initial volume of water, the initial reducing sugar, the initial source of copper (II) ions and the initial source of halide ions to the container to form a combination; heating the combination to 110 to 160° C.; comingling the first part of the initial polyvinyl pyrrolidone (PVP) with the first portion of the initial source of silver ions to form a comingled polyvinyl pyrrolidone/source of silver ions; adding the comingled polyvinyl pyrrolidone/source of silver ions to the combination in the container to form a creation mixture; then, following a delay period, adding to the container the second part of the initial polyvinyl pyrrolidone (PVP) and the second portion of the initial source of silver ions to form a growth mixture; maintaining the growth mixture at 110 to 160° C. for a hold period of 2 to 30 hours to produce a raw feed wherein a total glycol concentration in the container is <0.001 wt %; wherein the raw feed produced comprise a mother liquor and silver solids; wherein the mother liquor comprises the initial volume of water; and wherein the silver solids in the raw feed include high aspect ratio silver nanowires and low aspect ratio silver particles; providing a dynamic filtration device, wherein the dynamic filtration device, comprises: a housing, comprising: a cavity having a first side and a second side; wherein there is at least one inlet to the first side of the cavity, at least one product outlet from the first side of the cavity and at least one permeate outlet from the second side of the cavity; and, a porous element disposed within the cavity; a turbulence inducing element disposed within the cavity; and, a pressure source; wherein the porous element is interposed between the first side of the cavity and the second side of the cavity; wherein the porous element has a plurality of passages that traverse from the first side of the cavity to the second side of the cavity; wherein the plurality of passages are large enough to permit transfer of the mother liquor and low aspect ratio silver particles and small enough to block transfer of the high aspect ratio silver nanowires; wherein the porous element and the turbulence inducing element cooperate to form a filtration gap, FG; and, wherein at least one of the porous element and the turbulence inducing element is moveable; providing a transport fluid, wherein the transport fluid comprises a supplemental volume of water and a supplemental polyvinyl pyrrolidone (PVP); transferring the raw feed to the dynamic filtration device through the at least one inlet to the first side of the cavity; transferring a volume of the transport fluid to the dynamic filtration device through the at least one inlet to the first side of the cavity; wherein the filtration gap, FG, is filled by water; wherein the porous element and the turbulence inducing element disposed within the cavity are both in contact with the water; pressurizing the first side of the cavity using the pressure source resulting in a first side pressure, $FS_P$, in the first side of the cavity; wherein the first side pressure, $FS_P$, is higher than a second side pressure, $SS_P$, in the second side of the cavity, whereby there is created a pressure drop ($PE_\Delta$) across the porous element from the first side of the cavity to the second side of the cavity; wherein the pressure source provides a primary motive force for inducing a flow from the first side of the cavity through the porous element to the second side of the cavity providing a permeate; moving at least one of the porous element and the turbulence inducing element whereby a shear stress is generated in the water in the filtration gap, FG; wherein the shear stress generated in the water in the filtration gap, FG, operates to reduce fouling of the porous element; withdrawing the permeate from the at least one permeate outlet from the second side of the cavity, wherein the permeate comprises a second cut of the mother liquor and a second fraction of the silver solids; wherein the second fraction of the silver solids is rich in low aspect ratio silver particles; and, withdrawing a product from the at least one product outlet from the first side of the cavity, wherein the product comprises a first cut of the mother liquor and a first fraction of the silver solids; wherein the first fraction of the silver solids is depleted in low aspect ratio silver particles; and, wherein the shear stress generated in the water in the filtration gap, FG, and the pressure drop ($PE_\Delta$) across the porous element from the first side of the cavity to the second side of the cavity are decoupled.

DETAILED DESCRIPTION

Figure 1:
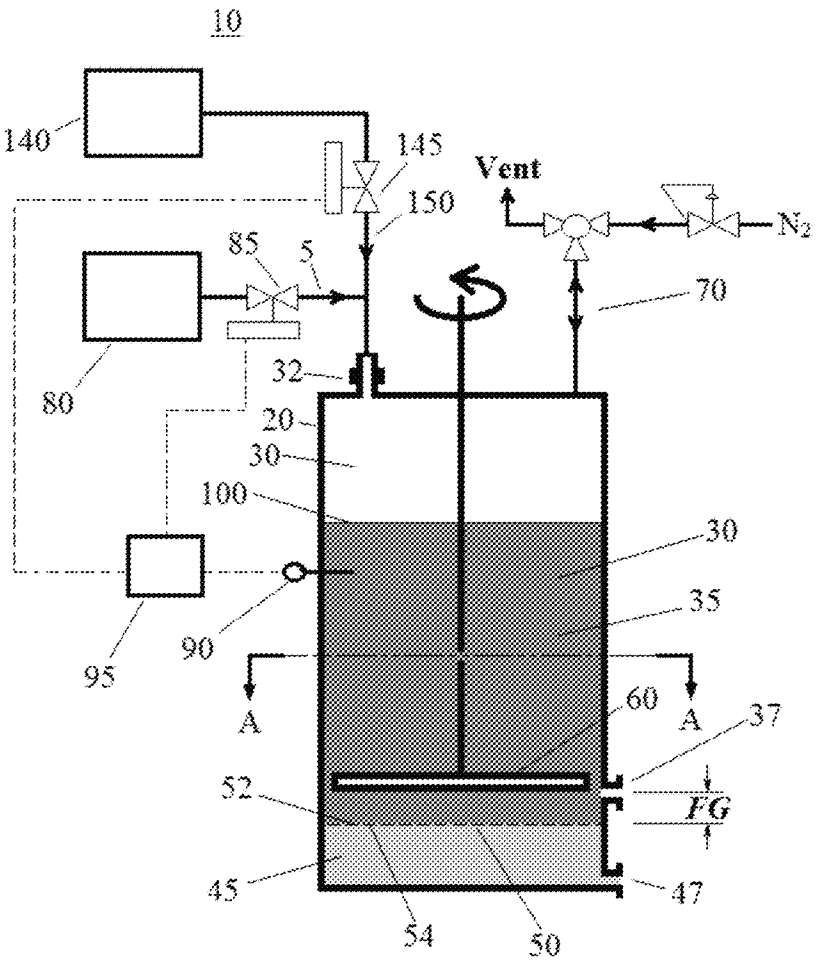
FIG. 1 is a depiction of a dynamic filtration device of the present invention.

A method for manufacturing filtered high aspect ratio silver nanowires has been found which surprisingly provides the effective separation of low aspect ratio silver particles from the silver solids present in a raw feed without significant loss of the desired high aspect ratio silver nanowires or significant reduction in the average length of the silver nanowires recovered in the product. It has been found that the composition of the transport fluid used in the separation process is critical for providing a high aspect ratio silver nanowire product having a high purity of high aspect ratio silver nanowires, wherein the nanowire fraction, $NW_F$, is ≥0.9. It has also been observed that the total throughput of transport fluid to the filtration device can be minimized through the judicious selection of the component content of the transport fluid. Finally, it has been observed that the judicious selection of the component content of the transport fluid imparts stability to the recovered high aspect ratio silver nanowire product. For example, recovered high aspect ratio silver nanowire product from the method of the invention facilitate the formation of optical films with enhanced optical quality having fewer wire tangles and visible defects.

The term "total glycol concentration" as used herein and in the appended claims means combined total of the concentration of all glycols (e.g., ethylene glycol, propylene glycol, butylene glycol, poly(ethylene glycol), poly(propylene glycol)) present in the container.

The term "high aspect ratio silver nanowires" as used herein and in the appended claims refers to silver solids having an aspect ratio >3.

The term "low aspect ratio silver particles" as used herein and in the appended claims refers to silver solids having an aspect ratio of ≤3.

The term "raw weight fraction" or "$WF_{Raw}$" as used herein and in the appended claims means the weight of high aspect ratio silver nanowires in the raw feed divided by the total weight of silver solids contained in the raw feed.

The term "permeate weight fraction" or "$WF_{Permeate}$" as used herein and in the appended claims means the weight of high aspect ratio silver nanowires in the permeate divided by the total weight of silver solids contained in the permeate.

The term "product weight fraction" or "$WF_{Product}$" as used herein and in the appended claims means the weight of high aspect ratio silver nanowires in the product divided by the total weight of silver solids contained in the product.

The term "first side pressure" or "$FS_P$", as used herein and in the appended claims means the pressure measured in the first side (35) of the cavity (30) relative to an atmospheric pressure on the outside of the housing (20).

The term "second side pressure" or "$SS_P$", as used herein and in the appended claims means the pressure measured in the second side (45) of the cavity (30) relative to an atmospheric pressure on the outside of the housing (20).

The term "pressure drop across the porous element" or "$PE_\Delta$" as used herein and in the appended claims means the difference between the first side pressure, $FS_P$, and the second side pressure, $SS_P$, i.e.

$$PE_\Delta = FS_P - SS_P$$

The term "substantially constant" as used herein and in the appended claims in reference to the cross sectional area, $X_{area}$, of a passage (55) through a porous element (50) means that the largest cross sectional area, ${}_LX_{area}$, exhibited by the given passage perpendicular to the flow of permeate through the thickness, T, of the porous element (55) is within 20% of the smallest such cross sectional area ${}_SX_{area}$, exhibited by the passage.

The term "substantially perpendicular" as used herein and in the appended claims in reference to an axis of symmetry, $axis_{sym}$, of a passage (55) through a porous element (50) means that the axis of symmetry, $axis_{sym}$, intersects the top surface (52) of the porous element (50) at an angle, γ, of 85 to 95°.

The term "High aspect ratio silver nanowire fraction" or "$NW_F$" used herein and in the appended claims is the silver nanowire fraction of a sample of silver nanowires determined according to the following equation:

$$NW_F = NW_A / T_A$$

wherein $T_A$ is the total surface area of a substrate that is occluded by a given deposited sample of silver solids; and, $NW_A$ is the portion of the total occluded surface area that is attributable to high aspect ratio silver nanowires in the deposited sample of silver solids using the method as described herein in the Examples.

Preferably, the method of manufacturing filtered high aspect ratio silver nanowires of the present invention, comprises: providing a container; providing an initial volume of water; providing an initial reducing sugar; providing an initial polyvinyl pyrrolidone (PVP), wherein the initial polyvinyl pyrrolidone (PVP) provided is dividable into a first part of the initial polyvinyl pyrrolidone (PVP) and a second part of the initial polyvinyl pyrrolidone (PVP); providing an initial source of copper (II) ions; providing an initial source of halide ions; providing an initial source of silver ions, wherein the initial source of silver ions provided is dividable into a first portion of the initial source of silver ions and a second portion of the initial source of silver ions; adding the initial volume of water, the initial reducing sugar, the initial source of copper (II) ions and the initial source of halide ions to the container to form a combination; heating the combination to 110 to 160° C.; comingling the first part of the initial polyvinyl pyrrolidone (PVP) with the first portion of the initial source of silver ions to form a comingled polyvinyl pyrrolidone/source of silver ions; adding the comingled polyvinyl pyrrolidone/source of silver ions to the combination in the container to form a creation mixture; then, following a delay period, adding to the container the second part of the initial polyvinyl pyrrolidone (PVP) and the second portion of the initial source of silver ions to form a growth mixture; maintaining the growth mixture at 110 to 160° C. for a hold period of 2 to 30 hours to produce a raw feed (5) wherein a total glycol concentration in the container is <0.001 wt %; wherein the raw feed produced comprise a mother liquor and silver solids; wherein the mother liquor comprises the initial volume of water; and wherein the silver solids in the raw feed (5) include high aspect ratio silver nanowires and low aspect ratio silver particles (preferably, wherein the raw feed has a raw weight fraction, $WF_{Raw}$); providing a dynamic filtration device (10), wherein the dynamic filtration device (10), comprises: a housing (20), comprising: a cavity (30) having a first side (35) and a second side (45); wherein there is at least one inlet (32) to the first side (35) of the cavity (30), at least one product outlet (37) from the first side (35) of the cavity (30) and at least one permeate outlet (47) from the second side (45) of the cavity (30); and, a porous element (50) disposed within the cavity (30); a turbulence inducing element (60) disposed within the cavity (30); and, a pressure source (70); wherein the porous element (50) is interposed between the first side (35) of the cavity (30) and the second side (45) of the cavity (30); wherein the porous element (50) has a plurality of passages (55) that traverse from the first side (35) of the cavity (30) to the second side (45) of the cavity (30); wherein the plurality of passages (55) are large enough to permit transfer of the mother liquor and low aspect ratio silver particles and small enough to block transfer of the high aspect ratio silver nanowires; wherein the porous element (50) and the turbulence inducing element (60) cooperate to form a filtration gap, FG; and, wherein at least one of the porous element (50) and the turbulence inducing element (60) is moveable; providing a transport fluid, wherein the transport fluid comprises a supplemental volume of water and a supplemental polyvinyl pyrrolidone (PVP); (preferably, wherein the raw feed comprises all of the contents of the container; preferably, wherein the raw feed has a raw weight fraction, $WF_{Raw}$); transferring the raw feed (5) to the dynamic filtration device (10) through the at least one inlet (32) to the first side (35) of the cavity (30); transferring a volume of the transport fluid to the dynamic filtration device (10) through the at least one inlet (30) to the first side (35) of the cavity (30); wherein the filtration gap, FG, is filled by water; wherein the porous element (50) and the turbulence inducing element (60) disposed within the cavity (30) are both in contact with the water; pressurizing the first side (35) of the cavity (30) using the pressure source (70) resulting in a first side pressure, $FS_P$, in the first side (35) of the cavity (30); wherein the first side pressure, $FS_P$, is higher than a second side pressure, $SS_P$, in the second side (45) of the cavity (30), whereby there is created a pressure drop ($PE_\Delta$) across the porous element (50) from the first side (35) of the cavity (30) to the second side (45) of the cavity (30); wherein the pressure source (70) provides a primary motive force for inducing a flow from the first side (35) of the cavity (30) through the porous element (50) to the second side (45) of the cavity (30) providing a permeate; moving (preferably, continuously moving) at least one of the porous element (50) and the turbulence inducing element (60) whereby a shear stress is generated in the water in the filtration gap, FG; wherein the shear stress generated in the water in the filtration gap, FG, operates to reduce fouling of the porous element (50); withdrawing the permeate from the at least one permeate outlet (47) from the second side (45) of the cavity (30), wherein the permeate comprises a second cut of the mother liquor and a second fraction of the silver solids; wherein the second fraction of the silver solids is rich in low aspect ratio silver particles (preferably, wherein the permeate has a permeate weight fraction, $WF_{Permeate}$; preferably, wherein $WF_{Raw}>WF_{Permeate}$; more preferably, wherein $WF_{Raw}>WF_{Permeate}\leq 0.05$; still more preferably, wherein $WF_{Raw}>WF_{Permeate}\leq 0.01$; most preferably, $WF_{Raw}>WF_{Permeate}\leq 0.001$); and, withdrawing a product from the at least one product outlet (37) from the first side (35) of the cavity (30), wherein the product comprises a first cut of the mother liquor and a first fraction of the silver solids; wherein the first fraction of the silver solids is depleted in low aspect ratio silver particles (preferably, wherein the product has a product weight fraction, $WF_{product}$; preferably, wherein $WF_{Raw}<WF_{Product}$; more preferably, wherein $WF_{Raw}<WF_{Product}\geq 0.8$; still more preferably, wherein $WF_{Raw}<WF_{Product}\geq 0.85$; most preferably, wherein $WF_{Raw}<WF_{Product}\geq 0.9$); and, wherein the shear stress generated in the water in the filtration gap, FG, and the pressure drop ($PE_\Delta$) across the porous element (50) from the first side (35) of the cavity (30) to the second side (45) of the cavity (30) are decoupled (i.e., independently controllable). (See FIG. 1).

Preferably, in the method for manufacturing filtered high aspect ratio silver nanowires of the present invention, the initial polyvinyl pyrrolidone (PVP) provided is divided into a first part of the initial polyvinyl pyrrolidone (PVP) and a second part of the initial polyvinyl pyrrolidone (PVP); and, the initial source of silver ions provided is divided into a first portion of the initial source of silver ions and a second portion of the initial source of silver ions; wherein the first part of the initial polyvinyl pyrrolidone (PVP) is comingled with the first portion of the initial source of silver ions to form the comingled polyvinyl pyrrolidone/source of silver ions; wherein the remaining initial polyvinyl pyrrolidone (PVP) is the second part of the initial polyvinyl pyrrolidone (PVP); and, wherein the remaining initial source of silver ions is the second portion of the of the initial source of silver ions. Preferably, the first part of the initial polyvinyl pyrrolidone (PVP) is 10 to 40 wt % (preferably, 10 to 30 wt %; more preferably, 15 to 25 wt %; most preferably, 20 wt %) of the initial polyvinyl pyrrolidone (PVP) provided; and, the first portion of the initial source of silver ions is 10 to 40 wt % (preferably, 10 to 30 wt %; more preferably, 15 to 25 wt %; most preferably, 20 wt %) of the initial source of silver ions provided. Preferably, the comingled polyvinyl pyrrolidone/source of silver ions is added to the combination in the container over a charge time of 10 seconds to 10 minutes (more preferably, 30 seconds to 5 minutes; most preferably, 30 to 90 seconds). Preferably, the second part of the initial polyvinyl pyrrolidone (PVP) and the second portion of the initial source of silver ions are added to the container over a feed time of 1 to 60 minutes (more preferably, 1 to 30 minutes; most preferably, 1 to 15 minutes).

Preferably, in the method for manufacturing filtered high aspect ratio silver nanowires of the present invention, the initial polyvinyl pyrrolidone (PVP) provided is divided into a first part and a second part and the initial source of silver ions provided is divided into a first portion and a second portion; wherein the first part of the initial polyvinyl pyrrolidone (PVP) and the first portion of the initial source of silver ions are comingled to form the comingled polyvinyl pyrrolidone/source of silver ions. Preferably, the first part of the initial polyvinyl pyrrolidone (PVP) and the first portion of the initial source of silver ions are comingled for a premix period of 0.5 seconds to 4 hours (preferably, 0.5 seconds to 1 hour; more preferably, 1 minute to 1 hour; most preferably, 5 minutes to 1 hour) to form the comingled polyvinyl pyrrolidone/source of silver ions. The first part of the initial polyvinyl pyrrolidone (PVP) and the first portion of the initial source of silver ions are comingled for the premix period using any method known to one of ordinary skill in the art. Preferably, the first part of the initial polyvinyl pyrrolidone (PVP) and the first portion of the initial source of silver ions are comingled by at least one of mixing the first part of the initial polyvinyl pyrrolidone (PVP) and the first portion of the initial source of silver ions in a closed container (preferably, under an inert atmosphere such as nitrogen); and, simultaneously transferring the first part of the initial polyvinyl pyrrolidone (PVP) and the first portion of the initial source of silver ions through a common conduit to the combination in the container. When the residence time in a common conduit for the first part of the initial polyvinyl pyrrolidone (PVP) and the first portion of the initial source of silver ions is equal to the premix period, the premix period is preferably 2 to 30 seconds; more preferably, 2 to 15 seconds; most preferably, 2 to 10 seconds).

Preferably, in the method for manufacturing filtered high aspect ratio silver nanowires of the present invention, the second part of the initial polyvinyl pyrrolidone (PVP) and the second portion of the initial source of silver ions can be added to the container contents sequentially, simultaneously as separate feeds, simultaneously as a comingled feed or some combination thereof (e.g., some sequentially, some simultaneously as separate feeds and some simultaneously as a comingled feed). Preferably, at least one of the second part of the initial polyvinyl pyrrolidone (PVP) and the second portion of the initial source of silver ions are added to the container at a point below a surface of the combination in the container. More preferably, at least the second portion of the source of silver ions is added to the container at a point below a surface of the combination in the container. Preferably, the second part of the initial polyvinyl pyrrolidone (PVP) and the second portion of the initial source of silver ions are added to the container simultaneously as separate feeds, simultaneously as a comingled feed or a combination thereof (e.g., some simultaneously as separate feeds and some simultaneously as a comingled feed). Most preferably, the second part of the initial polyvinyl pyrrolidone (PVP) and the second portion of the initial source of silver ions are added to the container as a comingled feed. Preferably, the comingled feed is added to the combination at a point below a surface of the combination in the container. The comingled feed can be formed in the same manner as described for the formation of the comingled polyvinyl pyrrolidone/source of silver ions, wherein the second part of the initial polyvinyl pyrrolidone (PVP) and the second portion of the initial source of silver ions used are comingled for a comingling period 0.5 seconds to 4 hours (preferably, 0.5 seconds to 2 hours; more preferably, 5 minutes to 1.5 hours; most preferably, 5 minutes to 1 hour) to form the comingled feed. Preferably, the comingling period is ≥the premix period.

Preferably, in the method of manufacturing filtered high aspect ratio silver nanowires of the present invention, the raw feed (5) comprises: a mother liquor and silver solids; wherein the mother liquor comprises the initial volume of water; and wherein the silver solids in the raw feed (5) include high aspect ratio silver nanowires and low aspect ratio silver particles. Preferably, the raw feed comprises the entirety of the container contents following the hold period. Preferably, the silver solids are suspended in the mother liquor. Preferably, the raw feed contains ≤2 wt % silver solids. More preferably, raw feed contains 0.01 to 1 wt % (still more preferably, 0.05 to 0.75 wt %; most preferably, 0.1 to 0.5 wt %) silver solids.

Preferable, in the method of manufacturing filtered high aspect ratio silver nanowires of the present invention, the silver solids contained in the raw feed include high aspect ratio silver nanowires and low aspect ratio silver particles. Preferably, wherein the raw feed has a raw weight fraction, $WF_{Raw}$, of high aspect ratio silver nanowires to low aspect ratio silver particles. Preferably, the raw weight fraction, $WF_{Raw}$, is maximized through the process used to synthesize the high aspect ratio silver nanowires. Nevertheless, the synthesis of high aspect ratio silver nanowires invariably yields some amount of undesirable low aspect ratio silver particles that are desirably removed such that the product weight fraction, $WF_{Product} > WF_{Raw}$.

Preferably, the method of manufacturing filtered high aspect ratio silver nanowires of the present invention, the transport fluid provided comprises: a supplemental volume of water and a supplemental polyvinyl pyrrolidone (PVP). More preferably, the transport fluid provided comprises: a supplemental volume of water; a supplemental polyvinyl pyrrolidone (PVP); and at least one of a supplemental reducing sugar, a supplemental source of halide ions, a supplemental source of copper (II) ions and a supplemental source of silver ions. Still more preferably, the transport fluid provided comprises: a cleaned permeate, wherein silver solids have been removed from the permeate. One of ordinary skill in the art will know to select an appropriate method for removing silver solids from the permeate to provide a cleaned permeate. Preferably, the silver solids are removed from the permeate using at least one of filtration and centrifugation to provide a cleaned permeate. Most preferably, the transport fluid provided comprises: a supplemental volume of water, a supplemental polyvinyl pyrrolidone (PVP) and a supplemental source of halide ions.

Preferably, the method of manufacturing filtered high aspect ratio silver nanowires of the present invention, the transport fluid provided has a pH of 2 to 5 (more preferably, of 2.5 to 4.5; most preferably, of 3 to 4).

Preferably, in the method of manufacturing filtered high aspect ratio silver nanowires of the present invention, the transport fluid provided is transferred to the dynamic filtration device through the at least one inlet to the first side of the cavity. Preferably, the volume of transport fluid can be transferred to the dynamic filtration device in a manner selected from at least one of a single shot, a plurality of shots (wherein the shots can contain the same amount or different amounts of the transport fluid) and continuously. More preferably, the method of manufacturing filtered high aspect ratio silver nanowires of the present invention, comprises: transferring a volume of the transport fluid to the dynamic filtration device through the at least one inlet to the first side of the cavity; wherein a concentration of the silver solids in the first side of the cavity is controlled by adjusting the volume of the transport fluid transferred to the first side of the cavity. Most preferably, the method of manufacturing filtered high aspect ratio silver nanowires of the present invention, comprises: transferring a volume of the transport fluid to the dynamic filtration device through the at least one inlet to the first side of the cavity; wherein the concentration of the silver solids in the first side of the cavity is maintained at ≤2 wt %. More preferably, the volume of transport fluid transferred to the dynamic filtration device is controlled such that the concentration of the silver solids in the first side of the cavity is maintained at 0.01 to 1 wt % (still more preferably, 0.05 to 0.75 wt %; most preferably, 0.1 to 0.5 wt %).

Preferably, in the method of manufacturing filtered high aspect ratio silver nanowires of the present invention, the raw feed (5) is transferred to the dynamic filtration device using a fluid mover (80). One of ordinary skill in the art will be able to select an appropriate fluid mover (80) for use with the raw feed. Preferably, in the method of manufacturing filtered high aspect ratio silver nanowires of the present invention, the fluid mover (80) used to transfer the raw feed (5) to the dynamic filtration device (10) is decoupled from the driving force used to induce a pressure drop ($PE_{\Delta}$) across the porous element (50) from the first side (35) of the cavity (30) in the dynamic filtration device (10) to the second side (45) of the cavity (30). More preferably, the raw feed is transferred to the dynamic filtration device (10) using a low shear fluid mover (80), such as a peristaltic pump or a system head pressure (e.g., gravity or inert gas pressure). Preferably, when a system head pressure is used as the fluid mover (80) to facilitate the transfer of raw feed (5) to the dynamic filtration device (10), the fluid mover (80) further comprises a fluid valve (85) (preferably a fluid control valve) to regulate the rate at which raw feed (5) is transferred to the dynamic filtration device (10). (See FIG. 1).

Preferably, the method of manufacturing filtered high aspect ratio silver nanowires of the present invention, further comprises: providing a liquid level sensor (90) and control circuit (95), wherein the liquid level sensor (90) and control circuit (95) are integrated with the dynamic filtration device (10) and the fluid mover (80) (preferably, a peristaltic pump or a system head pressure coupled with a control valve (85)) to maintain a stable liquid level (100) in the housing (20) such that the filtration gap (FG) remains filled by water. (See FIG. 1).

Figure 4:
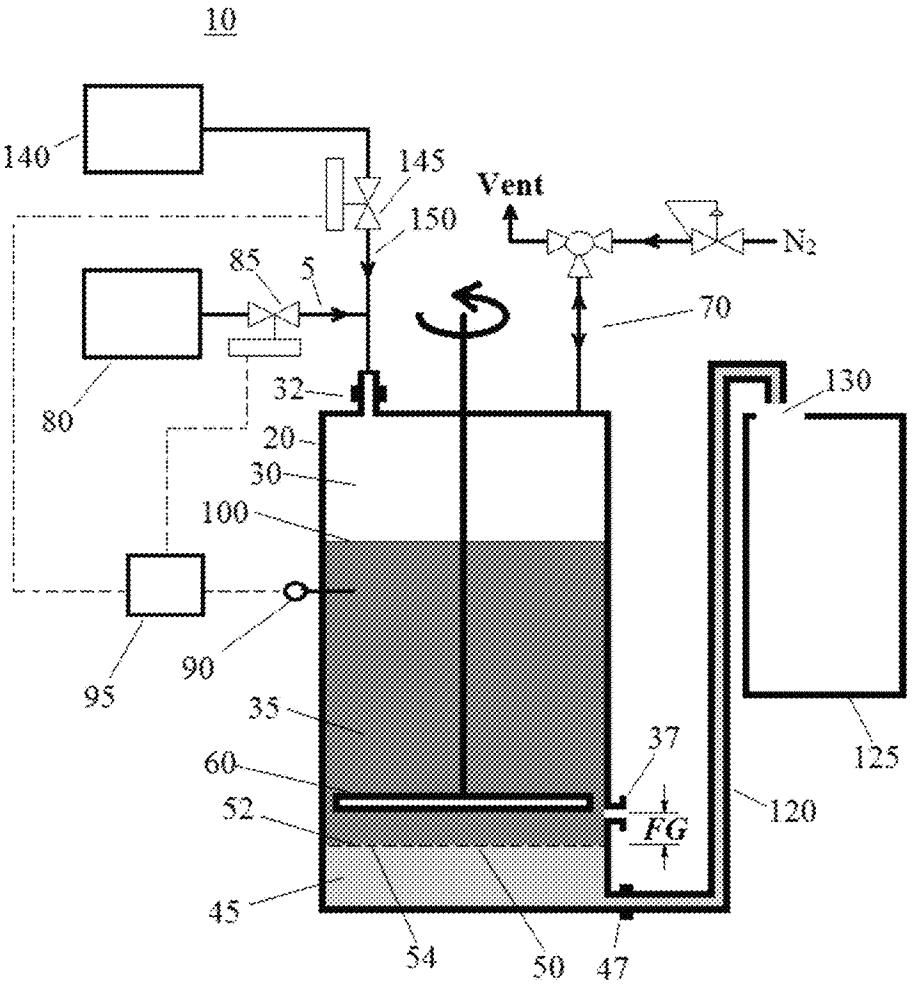
FIG. 4 is a depiction of a dynamic filtration device of the present invention with an associated permeate container.

Preferably, in the method of manufacturing filtered high aspect ratio silver nanowires of the present invention, the volume (150) of the transport fluid is transferred to the dynamic filtration device (10) using a liquid mover (140). One of ordinary skill in the art will be able to select an appropriate liquid mover (140) for use with the transport fluid. Preferably, in the method of manufacturing high aspect ratio silver nanowires of the present invention, the liquid mover (140) used to transfer the volume (150) of the transport fluid to the dynamic filtration device (10) is decoupled from the driving force used to induce a pressure drop ($PE_{\Delta}$) across the porous element (50) from the first side (35) of the cavity (30) in the dynamic filtration device (10) to the second side (45) of the cavity (30). More preferably, the volume of the transport fluid is transferred to the dynamic filtration device (10) using a pump or a system head pressure (e.g., gravity or inert gas pressure). Preferably, the dynamic filtration device (10) further comprises a liquid valve (145) (preferably a liquid control valve (145)) to regulate the transfer of transport fluid to the dynamic filtration device (10). (See FIG. 4).

Preferably, the method of manufacturing filtered high aspect ratio silver nanowires of the present invention, further comprises: providing a liquid level sensor (90) and control circuit (95), wherein the liquid level sensor (90) and control circuit (95)(preferably, wherein the control circuit includes a programmable logic controller) are integrated with the dynamic filtration device (10), the fluid mover (80) (preferably, a peristaltic pump or a system head pressure coupled with a fluid control valve (85)), and a liquid control valve (145) to maintain a stable liquid level (100) in the housing (20) such that the filtration gap (FG) remains filled by the mother liquor. (See FIG. 4).

Figure 2:
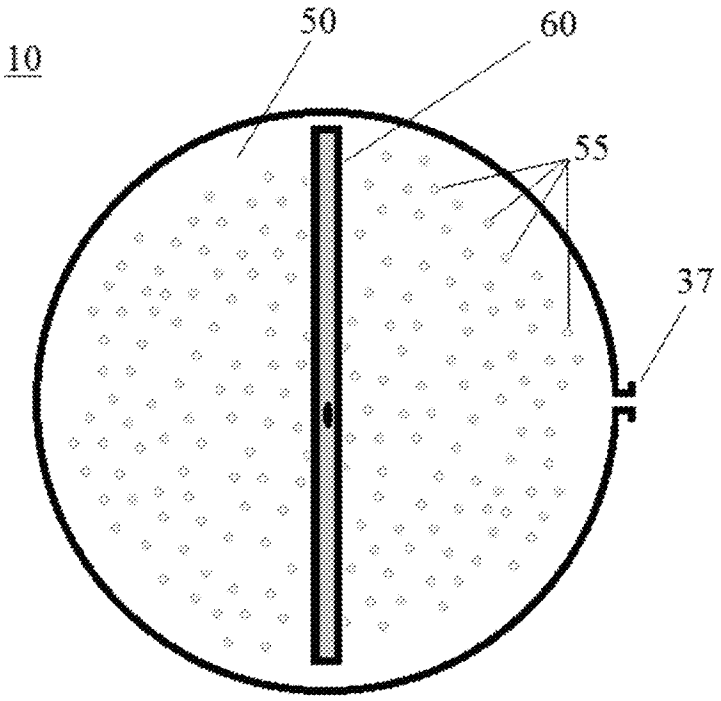
FIG. 2 is a depiction of a cross sectional view taken along line A-A in FIG. 1.
Figure 3:
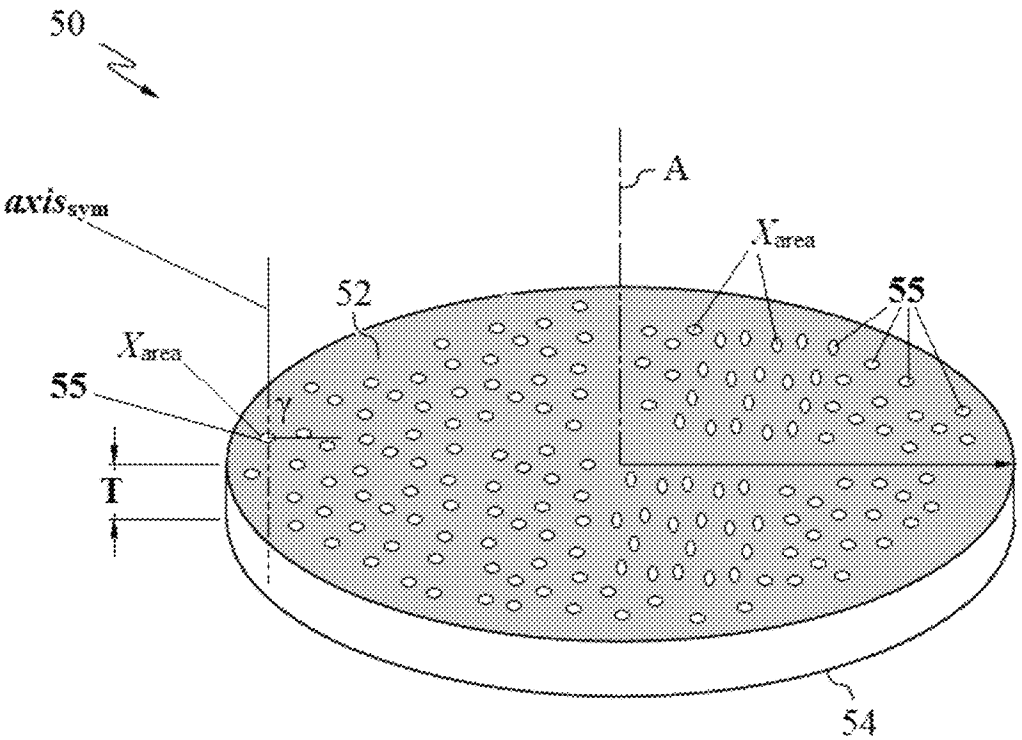
FIG. 3 is a depiction of a perspective view of a porous element disposed within a dynamic filtration device of the present invention.

Preferably, in the method of manufacturing filtered high aspect ratio silver nanowires of the present invention, the porous element (50) used in the dynamic filtration device (10) has a plurality of passages (55) that traverse from the first side (35) of the cavity (30) to the second side (45) of the cavity (30); wherein the plurality of passages (55) are large enough to permit transfer of mother liquor and low aspect ratio silver particles and small enough to block transfer of high aspect ratio silver nanowires. More preferably, each passage (55), in the plurality of passages (55), has a cross sectional area, $X_{area}$, perpendicular to the flow of permeate through the thickness, T, of the porous element (50); wherein the cross sectional area, $X_{area}$, is substantially constant across the thickness, T, of the porous element (50). Preferably, the porous element (50) has a pore size rated at 1 to 10 μm (more preferably, 2 to 8 μm; still more preferably, 2 to 5 μm; most preferably, 2.5 to 3.5 μm). Preferably, the porous element is selected from curved porous elements and flat porous elements. More preferably, the porous element is a flat porous element. Preferably, in the method of manufacturing high aspect ratio silver nanowires of the present invention, the porous element (50) used in the dynamic filtration device (10) is a porous membrane. More preferably, the porous element (50) is a track etched polycarbonate (PCTE) membrane. (See FIGS. 1-3).

Preferably, in the method of manufacturing filtered high aspect ratio silver nanowires of the present invention, shear stress is generated in the water present in the filtration gap, FG; wherein the shear stress induces sufficient movement in the water tangential to the top surface (52) of the porous element (50) to reduce or prevent blinding or fouling of the porous element. The shear stress is generated by a relative motion between the porous element (50) and the turbulence inducing element (60) adjacent to the filtration gap, FG.

Preferably, in the method of manufacturing filtered high aspect ratio silver nanowires of the present invention, wherein the porous element (50) is stationary relative to the cavity (30), the turbulence inducing element (60) moves relative to the porous element (50). Preferably, when the porous element (50) is a stationary and flat porous element, the turbulence inducing element (60) rotates in a plane proximate the top surface (52) of the porous element (50). More preferably, when the porous element (50) is a flat, porous membrane; the turbulence inducing element (60) is an agitator. Preferably, the agitator is selected from the group consisting of a stir bar, a stir bar depending from and secured to (or integral with) a shaft, and an impeller mounted to a shaft. Preferably, the porous membrane is flat and has a top surface (52) and a bottom surface (54); wherein the top surface (52) and the bottom surface (54) are parallel; wherein the porous membrane has a thickness, T, measured from the top surface (52) to the bottom surface (54) along a line (A) normal to the top surface (52); and, wherein the top surface (52) faces the turbulence inducing element (60). Preferably, the turbulence inducing element (60) provided with the flat porous membrane is an agitator with an impeller; wherein the impeller is continuously rotated in a plane disposed in the first side (32) of the cavity (30). Preferably, the filtration gap is defined by the plane in which the impeller is continuously rotated and the top surface (52) of the porous element (50) proximate to the impeller (more preferably, wherein the plane is parallel to the top surface of the porous element). (See FIGS. 1-3).

Preferably, in the method of manufacturing filtered high aspect ratio silver nanowires of the present invention, the turbulence inducing element has a permeable surface. More preferably, when the turbulence inducing element has a permeable surface, the permeable surface is interposed between the first side of the cavity and the second side of the cavity and at least some of the permeate withdrawn from the dynamic filtration device passes through the permeable surface of the turbulence inducing element from the first side of the cavity to the second side of the cavity. Preferably, when the turbulence inducing element has a permeable surface, the permeable surface of the turbulence inducing element faces the plurality of passages of the porous element. Preferably, when the turbulence inducing element has a permeable surface, the permeable surface is curved and disposed about a central axis of rotation; wherein the turbulence inducing element rotates about the central axis. More preferably, when the turbulence inducing element has a curved permeable surface, disposed about a central axis of rotation; wherein the turbulence inducing element rotates about the central axis; the porous element also has a curved surface disposed about a central axis of rotation; wherein the porous element curved surface has a plurality of passages that traverse from the first side of the cavity to the second side of the cavity; wherein the porous element rotates about its central axis; wherein the turbulence inducing element curved permeable surface faces the porous element curved surface; wherein the space interposed between the turbulence inducing element curved permeable surface and the porous element curved surface defines the filtration gap, FG. Preferably, the central axis of rotation of the turbulence inducing element and that of the porous element are parallel. Preferably, the turbulence inducing element and the porous element rotate in the same direction. Preferably, the turbulence inducing element and the porous element counter rotate.

Preferably, in the method of manufacturing filtered high aspect ratio silver nanowires of the present invention, the filtration gap, FG, is disposed in the filter housing and is interposed between the first side (35) of the cavity (30) and the second side (45) of the cavity (30); wherein the filtration gap, FG, is defined by two opposing surfaces; wherein at least one of the opposing surfaces is moveable; and, wherein the porous element (50) provides at least one of the opposing surfaces. The filtration gap, FG, is typically formed between oppositely disposed, facing surface that are spaced apart by a distance of 1 to 25 mm (preferably, 1 to 20 mm; more preferably, 1 to 15 mm; most preferably, 1 to 10 mm). Preferably, the size of the filtration gap, FG, is substantially constant across the opposing surface provided by the porous element (50) (i.e., wherein the largest filtration gap size, $FGS_L$, and the smallest filtration gap size, FGSs, between the opposing surfaces are related as follows: $0.9\ FGS_L \leq FGS_S \leq FGS_L$). (See FIGS. 1 and 4).

Preferably, in the method of manufacturing filtered high aspect ratio silver nanowires of the present invention, at least one of the porous element (50) and the turbulence inducing element (60) moves relative to each other to generate a shear stress in the water in a filtration gap, FG, between opposing surfaces of the porous element (50) and the turbulence inducing element (60). More preferably, at least one of the porous element (50) and the turbulence inducing element (60) moves continuously relative to other to generate a shear stress in the water in a filtration gap, FG, between opposing surfaces of the porous element (50) and the turbulence inducing element (60). Preferably, the shear stress generated in the filtration gap, FG, induces sufficient movement in the water tangential to the surface of the porous element facing the first side (35) of the cavity (30) to reduce or prevent blinding or fouling of the porous element. Preferably, the porous element (50) and the turbulence inducing element (60) move relative to each other at a relative velocity of 0.4 to 1.5 m/s (more preferably, 0.6 to 1.3 m/s; most preferably, 0.9 to 1.1 m/s).

Preferably, the shear stress generated in the water disposed within the filtration gap, FG, and the pressure drop across the porous element from the first side of the cavity to the second side of the cavity are decoupled. Most preferably, the shear stress generated in the water disposed within the filtration gap, FG, and the pressure drop across the porous element from the first side of the cavity to the second side of the cavity are independently controllable.

Preferably, in the method of manufacturing filtered high aspect ratio silver nanowires of the present invention, the pressure source provides the primary motive force for the passage of permeate through the porous element to the second side of the cavity. Preferably, the pressure source is a gas pressure exerted on the first side of the cavity. More preferably, the gas pressure exerted on the first side of the cavity is an inert gas. Most preferably, the gas pressure exerted on the first side of the cavity is nitrogen. The gas pressure can be applied to the first side of the cavity in the form of a gaseous head space above the liquid level in the cavity. Alternatively, the first side of the cavity provided may further comprise a bladder; wherein the bladder is pressurized with the gas. Preferably, the pressure source induces a pressure drop across the porous element of 5 to 70 kPA (preferably, 10 to 55 kPa; more preferably, 15 to 40 kPa; most preferably, 20 to 35 kPa).

Preferably, the method of manufacturing filtered high aspect ratio silver nanowires of the present invention, further comprises: periodically providing a reverse flow through the porous element (50) from the second side (45) of the cavity (30) to the first side (35) of the cavity (30). One of ordinary skill in the art will know to select appropriate means for providing the reverse flow. More preferably, the method of manufacturing high aspect ratio silver nanowires of the present invention, further comprises: periodically providing a reverse flow through the porous element (50) from the second side (45) of the cavity (30) to the first side (35) of the cavity (30); wherein the reverse flow is provided for a period of 1 to 10 seconds (more preferably, of 2.5 to 7.5 seconds; most preferably, of 3 to 5 seconds) every 10 to 60 seconds (more preferably, 15 to 40 seconds; most preferably, 20 to 30 seconds).

Preferably, the method of manufacturing filtered high aspect ratio silver nanowires of the present invention, further comprises: providing a conduit (120) for transferring permeate from the at least one outlet (47) from the second side (45) of the cavity (30) to a container (125) (preferably, wherein there is an air gap (130) between conduit (120) and the container (125)). More preferably, the method of manufacturing high aspect ratio silver nanowires of the present invention, further comprises: providing a conduit (120) for transferring permeate from the at least one outlet (47) from the second side (45) of the cavity (30) to a container (125) (preferably, wherein there is an air gap (130) between conduit (120) and the container (125)); and, periodically, momentarily depressurizing the first side (35) of the cavity (30) by relieving the pressure source (70) (e.g., venting the first side of the cavity to atmosphere); wherein the conduit (120) holds a volume of permeate that is at an elevation that is higher than that of the liquid level (100) in the dynamic filtration device (10) (preferably, wherein the volume of permeate that is at an elevation that is higher than that of the liquid level (100) has a head of 20 to 500 mm (more preferably, 100 to 375 mm; most preferably, 150 to 300 mm) such that when periodically, momentarily depressurizing the first side (35) of the cavity (30) there is a reversal of flow through the porous element (50) from the second side (45) of the cavity (30) to the first side (35) of the cavity (30). Preferably, the periodic, momentary depressurizing is provided for a period of 1 to 10 seconds (more preferably, of 2.5 to 7.5 seconds; most preferably, of 3 to 5 seconds) every 10 to 60 seconds (more preferably, 15 to 40 seconds; most preferably, 20 to 30 seconds) of pressurizing. (See FIG. 4).

Preferably, the method of manufacturing filtered high aspect ratio silver nanowires of the present invention, further comprises: providing a vibrational energy source; and, periodically applying vibrational energy from the vibrational energy source to the porous element.

Preferably, the method of manufacturing filtered high aspect ratio silver nanowires of the present invention, further comprises: providing an ultrasonic energy source; and, periodically applying ultrasonic energy from the ultrasonic energy source to the porous element.

Preferably, the method of manufacturing filtered high aspect ratio silver nanowires of the present invention, further comprises: removing the silver solids from the permeate to provide a cleaned permeate; and, recycling the cleaned permeate to the dynamic filtration device through the at least one inlet to the first side of the cavity. Preferably, the silver solids are removed from the permeate using any suitable method know by those of ordinary skill in the art to provide the cleaned permeate. More preferably, the silver solids are removed using at least one of filtration and centrifugation to provide the cleaned permeate. Most preferably, the transport fluid comprises the cleaned permeate.

Preferably, the method of manufacturing filtered high aspect ratio silver nanowires of the present invention, provides a volumetric flux of permeate through the porous element of 20 to 1,000 $L/m^2 \cdot hour$ (more preferably, 140 to 540 $L/m^2 \cdot hour$; most preferably, 280 to 360 $L/m^2 \cdot hour$).

Preferably, the initial volume of water and the supplemental water provided in the method for manufacturing filtered high aspect ratio silver nanowires of the present invention are each independently at least one of deionized and distilled to limit incidental impurities. More preferably, the initial volume of water and the supplemental water provided in the method for manufacturing filtered high aspect ratio silver nanowires of the present invention are each both deionized and distilled. Most preferably, the initial volume of water and the supplemental water provided in the method for manufacturing filtered high aspect ratio silver nanowires of the present invention are each ultrapure water that meets or exceeds the Type 1 water requirements according to ASTM D1193-99e1 (Standard Specification for Reagent Water).

Preferably, the initial reducing sugar and the supplemental reducing sugar, if any, provided in the method for manufacturing filtered high aspect ratio silver nanowires of the present invention are independently selected from the group consisting of at least one of aldoses (e.g., glucose, glyceraldehyde, galactose, mannose); disaccharides with a free hemiacetal unit (e.g., lactose and maltose); and ketone bearing sugars (e.g., fructose). More preferably, the initial reducing sugar and the supplemental reducing sugar, if any, provided in the method for manufacturing filtered high aspect ratio silver nanowires of the present invention are independently selected from the group consisting of at least one of an aldose, lactose, maltose and fructose. Still more preferably, the initial reducing sugar and the supplemental reducing sugar, if any, provided in the method for manufacturing filtered high aspect ratio silver nanowires of the present invention are independently selected from the group consisting of at least one of glucose, glyceraldehyde, galactose, mannose, lactose, fructose and maltose. Preferably, the initial reducing sugar and the supplemental reducing sugar, if any, provided are the same. Most preferably, the initial reducing sugar and the supplemental reducing sugar, if any, provided in the method for manufacturing filtered high aspect ratio silver nanowires of the present invention are both D-glucose.

Preferably, the initial polyvinyl pyrrolidone (PVP) and the supplemental polyvinyl pyrrolidone (PVP), if any, provided in the method for manufacturing filtered high aspect ratio silver nanowires of the present invention each have a weight average molecular weight, $M_W$, of 20,000 to 300,000 Daltons. More preferably, the initial polyvinyl pyrrolidone (PVP) and the supplemental polyvinyl pyrrolidone (PVP), if any, provided in the method for manufacturing filtered high aspect ratio silver nanowires of the present invention each have a weight average molecular weight, $M_W$, of 30,000 to 200,000 Daltons. Most preferably, the initial polyvinyl pyrrolidone (PVP) and the supplemental polyvinyl pyrrolidone (PVP), if any, provided in the method for manufacturing filtered high aspect ratio silver nanowires of the present invention each have a weight average molecular weight, $M_W$, of 40,000 to 60,000 Daltons.

Preferably, the initial source of copper (II) ions and supplemental copper (II) ions, if any, provided in the method for manufacturing filtered high aspect ratio silver nanowires of the present invention are independently selected from the group consisting of at least one of $CuCl_2$ and $Cu(NO_3)_2$. More preferably, the initial source of copper (II) ions and supplemental copper (II) ions, if any, provided in the method for manufacturing filtered high aspect ratio silver nanowires of the present invention are independently selected from the group consisting of $CuCl_2$ and $Cu(NO_3)_2$. Preferably, the initial source of copper (II) ions and supplemental copper (II) ions, if any, provided are the same. Most preferably, the initial source of copper (II) ions and supplemental copper (II) ions, if any, provided in the method for manufacturing filtered high aspect ratio silver nanowires of the present invention are each $CuCl_2$, wherein the $CuCl_2$ is a copper (II) chloride dihydrate.

Preferably, the initial source of halide ions and the supplemental source of halide ions, if any, provided in the method for manufacturing filtered high aspect ratio silver nanowires of the present invention are independently selected from the group consisting of at least one of a source of chloride ions, a source of fluoride ions, a source of bromide ions and a source of iodide ions. More preferably, the initial source of halide ions and the supplemental source of halide ions, if any, provided in the method for manufacturing filtered high aspect ratio silver nanowires of the present invention are independently selected from the group consisting of at least one of a source of chloride ions and a source of fluoride ions. Still more preferably, the initial source of halide ions and the supplemental source of halide ions, if any, provided in the method for manufacturing filtered high aspect ratio silver nanowires of the present invention are each a source of chloride ions. Preferably, the initial source of halide ions and the supplemental source of halide ions, if any, provided are the same. Most preferably, the initial source of halide ions and the supplemental source of halide ions, if any, provided in the method for manufacturing filtered high aspect ratio silver nanowires of the present invention are each a source of chloride ions, wherein the source of chloride ions is an alkali metal chloride. Preferably, the alkali metal chloride is selected from the group consisting of at least one of sodium chloride, potassium chloride and lithium chloride. More preferably, the alkali metal chloride is selected from the group consisting of at least one of sodium chloride and potassium chloride. Most preferably, the alkali metal chloride is sodium chloride.

Preferably, the initial source of silver ions and the supplemental source of silver ions, if any, provided in the method for manufacturing filtered high aspect ratio silver nanowires of the present invention are each a silver complex. More Preferably, the initial source of silver ions and the supplemental source of silver ions, if any, provided in the method for manufacturing filtered high aspect ratio silver nanowires of the present invention are each a silver complex; wherein the silver complex is selected from the group consisting of at least one of silver nitrate ($AgNO_3$) and silver acetate ($AgC_2H_3O_2$). Most preferably, the initial source of silver ions and the supplemental source of silver ions, if any, provided in the method for manufacturing filtered high aspect ratio silver nanowires of the present invention are each silver nitrate ($AgNO_3$). Preferably, the initial source of silver ions and the supplemental source of silver ions, if any, provided in the method for manufacturing filtered high aspect ratio silver nanowires of the present invention each have a silver concentration of 0.005 to 1 molar (M)(more preferably, of 0.01 to 0.1 M; most preferably, of 0.015 to 0.05 M).

Preferably, the initial volume of water, the initial reducing sugar, the initial source of copper (II) ions, the initial source of halide ions and the pH adjusting agent, if any, are added to the container in any order in individual sequence (i.e., one at a time), simultaneously (i.e., all at the same time), or semi-simultaneously (i.e., some individually one at a time, some simultaneously at the same time or as subcombinations). More preferably, at least two of the initial volume of water, the initial reducing sugar, the initial source of copper (II) ions, the initial source of halide ions and the pH adjusting agent are mixed together to form a subcombination before addition to the container.

Preferably, the initial volume of water is divided into multiple volumes (preferably, at least two volumes of water; more preferably, at least three volumes of water; most preferably, at least five volumes of water) that are then mixed with one or more of the initial reducing sugar, the initial source of copper (II) ions, the initial source of halide ions, the pH adjusting agent, the initial polyvinyl pyrrolidone (PVP) provided and the source of silver ions provided to form various subcombinations that include water before addition to the container. For example, the initial volume of water is preferably divided into at least five volumes, wherein a first volume of water is combined with the initial reducing sugar to form a reducing sugar containing subcombination, wherein a second volume of water is combined with the initial source of copper (II) ions to form a copper (II) ion containing subcombination, wherein a third volume of water is combined with the initial source of halide ions to form a halide ion containing subcombination; wherein a forth volume of water is combined with the source of silver ions provided to form a silver ion containing subcombination (preferably, wherein the silver ion containing subcombination is divided into a first portion and a second portion); and a fifth volume of water is combined with the initial polyvinyl pyrrolidone (PVP) provided to form a polyvinyl pyrrolidone (PVP) containing subcombination (preferably, the polyvinyl pyrrolidone (PVP) containing subcombination is divided into a first part and a second part). These subcombinations are then processed in similar fashion to the single components in the previous discussion of the method for manufacturing filtered high aspect ratio silver nanowires of the present invention.

The method for manufacturing filtered high aspect ratio silver nanowires of the present invention preferably further comprises: providing a reducing agent; and, adding the reducing agent to the creation mixture.

Preferably, the reducing agent provided in the method for manufacturing filtered high aspect ratio silver nanowires of the present invention is selected from the group consisting of ascorbic acid, sodium borohydride ($NaBH_4$), hydrazine, salts of hydrazine, hydroquinone, $C_{1-5}$ alkyl aldehyde and benzaldehyde. More preferably, the reducing agent provided in the method for manufacturing filtered high aspect ratio silver nanowires of the present invention is selected from the group consisting of ascorbic acid, sodium borohydride ($NaBH_4$), hydrazine, salts of hydrazine, hydroquinone, acetaldehyde, propionaldehyde and benzaldehyde. Most preferably, the reducing agent provided in the method for manufacturing filtered high aspect ratio silver nanowires of the present invention is selected from the group consisting of ascorbic acid and sodium borohydride.

The method for manufacturing filtered high aspect ratio silver nanowires of the present invention preferably further comprises: providing a pH adjusting agent; and, adding the pH adjusting agent to the container. The pH adjusting agent can be added to the container before the comingled polyvinyl pyrrolidone/source of silver ions is added to the container. Preferably, when the pH adjusting agent is added to the combination before adding the comingled polyvinyl pyrrolidone/source of silver ions; wherein the combination has a pH of 2.0 to 4.0 (preferably, 2.0 to 3.5; more preferably, 2.4 to 3.3; most preferably, 2.4 to 2.6) before adding the comingled polyvinyl pyrrolidone/source of silver ions to the container. The pH adjusting agent can be added to the container simultaneously with the comingled polyvinyl pyrrolidone/source of silver ions. Preferably, when the pH adjusting agent is added simultaneously with the comingled polyvinyl pyrrolidone/source of silver ions, the pH adjusting agent is added to the first part of the initial polyvinyl pyrrolidone (PVP) before comingling with the first portion of the source of silver ions to form the comingled polyvinyl pyrrolidone/source of silver ions, wherein the first part of the initial polyvinyl pyrrolidone (PVP) has a pH of 2.0 to 4.0 (preferably, 2.0 to 3.5; more preferably, 2.3 to 3.3; most preferably, 3.1 to 3.3). Preferably, when the pH adjusting agent is added simultaneously with the comingled polyvinyl pyrrolidone/source of silver ions, the pH adjusting agent is also added to second part of the initial polyvinyl pyrrolidone (PVP), wherein the second part of the initial polyvinyl pyrrolidone (PVP) has a pH of 2.0 to 4.0 (preferably, 2.0 to 3.5; more preferably, 2.3 to 3.3; most preferably, 3.1 to 3.3). Preferably, the pH adjusting agent is added to the initial polyvinyl pyrrolidone (PVP) provided before dividing the initial polyvinyl pyrrolidone (PVP) provided into a first part and a second part, wherein the initial polyvinyl pyrrolidone (PVP) provided has a pH of 2.0 to 4.0 (preferably, 2.0 to 3.5; more preferably, 2.3 to 3.3; most preferably, 3.1 to 3.3).

Preferably, the pH adjusting agent provided in the method for manufacturing filtered high aspect ratio silver nanowires of the present invention is an acid. More preferably, the pH adjusting agent provided in the method for manufacturing filtered high aspect ratio silver nanowires of the present invention is an acid, wherein the acid is selected from the group consisting of at least one of inorganic acids (e.g., nitric acid, sulfuric acid, hydrochloric acid, fluorosulfuric acid, phosphoric acid, fluoroantimonic acid) and organic acids (e.g., methane sulfonic acid, ethane sulfonic acid, benzene sulfonic acid, acetic acid, fluoroacetic acid, chloroacetic acid, citric acid, gluconic acid, lactic acid). Preferably, the pH adjusted agent provided in the method for manufacturing filtered high aspect ratio silver nanowires of the present invention has a pH of <2.0. Still more preferably, the pH adjusting agent provided in the method for manufacturing filtered high aspect ratio silver nanowires of the present invention includes nitric acid. Most preferably, the pH adjusting agent provided in the method for manufacturing filtered high aspect ratio silver nanowires of the present invention is aqueous nitric acid.

Preferably, the method for manufacturing filtered high aspect ratio silver nanowires of the present invention, further comprises: purging a container vapor space in contact with the combination in the container to provide a reduced oxygen gas concentration in the container vapor space. Preferably, the step of purging the container vapor space in contact with the combination in the container to provide the reduced oxygen gas concentration in the container vapor space, includes: (i) isolating the container vapor space from a surrounding atmosphere outside the container; (ii) then pressuring the container vapor space with an inert gas (preferably, wherein the inert gas is selected from the group consisting of argon, helium, methane, and nitrogen (more preferably, argon, helium and nitrogen; still more preferably, argon and nitrogen; most preferably, nitrogen)); and, (iii) then purging the container vapor space to provide the reduced oxygen gas concentration in the container vapor space. Preferably, the container vapor space is purged down to a container pressure that is >an atmospheric pressure of the surrounding atmosphere) to provide the reduced oxygen gas concentration in the container vapor space. Preferably, the reduced oxygen gas concentration is ≤2,000 ppm (more preferably, ≤400 ppm; most preferably; ≤20 ppm)). More preferably, the step of purging the container vapor space in contact with the combination in the container to provide the reduced oxygen gas concentration in the container vapor space, includes: (i) isolating the container vapor space from a surrounding atmosphere outside the container; (ii) then pressuring the container vapor space with an inert gas (preferably, wherein the inert gas is selected from the group consisting of argon, helium, methane, and nitrogen (more preferably, argon, helium and nitrogen; still more preferably, argon and nitrogen; most preferably, nitrogen)); and, (iii) then purging the container vapor space to provide the reduced oxygen gas concentration in the container vapor space (preferably, wherein the container vapor space is purged down to a container pressure that is >an atmospheric pressure of the surrounding atmosphere outside the container); and, (iv) repeating steps (ii) and (iii) at least three times to provide the reduced oxygen gas concentration in the container vapor space (preferably, wherein the reduced oxygen gas concentration is ≤2,000 ppm (more preferably, ≤400 ppm; most preferably; ≤20 ppm)). Preferably, the method for manufacturing filtered high aspect ratio silver nanowires of the present invention, further comprises: maintaining the reduced oxygen gas concentration in the container vapor space during addition of the comingled polyvinyl pyrrolidone/source of silver ions, during formation of the growth mixture, and during the hold period.

Preferably, the method for manufacturing filtered high aspect ratio silver nanowires of the present invention, further comprises: sparging the initial source of silver ions provided with an inert gas to extract entrained oxygen gas from the initial source of silver ions and to provide a low oxygen gas concentration in a silver ion vapor space in contact with the initial source of silver ions. Preferably, the step of sparging the initial source of silver ions provided with an inert gas comprises (preferably, consists of): sparging the initial source of silver ions provided with an inert gas (preferably, wherein the inert gas is selected from the group consisting of argon, helium, methane, and nitrogen (more preferably, argon, helium and nitrogen; still more preferably, argon and nitrogen; most preferably, nitrogen)) for a sparging time of ≥5 minutes (more preferably, 5 minutes to 2 hours; most preferably, 5 minutes to 1.5 hours) before addition to the container to extract entrained oxygen gas from the initial source of silver ions provided and to provide a low oxygen gas concentration in the silver ion vapor space. Preferably, the low oxygen gas concentration in the silver ion vapor space is ≤10,000 ppm (preferably; ≤1,000 ppm; more preferably, ≤400 ppm; most preferably; ≤20 ppm). Preferably, the method for manufacturing filtered high aspect ratio silver nanowires of the present invention, further comprises: maintaining the low oxygen gas concentration in the silver ion vapor space until the initial source of silver ions provided is added to the container.

Preferably, the method for manufacturing filtered high aspect ratio silver nanowires of the present invention, further comprises: purging a PVP vapor space in contact with the initial polyvinyl pyrrolidone (PVP) provided to provide a diluted oxygen gas concentration in the PVP vapor space. Preferably, the step of purging the PVP vapor space to provide the diluted oxygen gas concentration in the PVP vapor space, includes: (i) isolating the initial polyvinyl pyrrolidone (PVP) provided; (ii) then pressuring the PVP vapor space with an inert gas (preferably, wherein the inert gas is selected from the group consisting of argon, helium, methane, and nitrogen (more preferably, argon, helium and nitrogen; still more preferably, argon and nitrogen; most preferably, nitrogen)); and, (iii) then purging the PVP vapor space to provide the diluted oxygen gas concentration in the PVP vapor space. Preferably, the PVP vapor space is purged down to a pressure that is >an atmospheric pressure of the surrounding atmosphere to provide the diluted oxygen gas concentration in the PVP vapor space. More preferably, the step of purging the PVP vapor space to provide the diluted oxygen gas concentration in the PVP vapor space, includes: (i) isolating the initial polyvinyl pyrrolidone (PVP) provided; (ii) then pressuring the PVP vapor space with an inert gas (preferably, wherein the inert gas is selected from the group consisting of argon, helium, methane, and nitrogen (more preferably, argon, helium and nitrogen; still more preferably, argon and nitrogen; most preferably, nitrogen)); (iii) then purging the PVP vapor space to provide the diluted oxygen gas concentration in the PVP vapor space (preferably, wherein the PVP vapor space is purged down to an inert gas pressure that is >an atmospheric pressure); and, (iv) repeating steps (ii) and (iii) at least three times to provide the diluted oxygen gas concentration in the PVP vapor space. Preferably, the diluted oxygen gas concentration in the PVP vapor space is ≤10,000 ppm (preferably; ≤1,000 ppm; more preferably, ≤400 ppm; most preferably; ≤20 ppm). Preferably, the method for manufacturing filtered high aspect ratio silver nanowires of the present invention, further comprises: maintaining the diluted oxygen gas concentration in the PVP vapor space until the initial polyvinyl pyrrolidone (PVP) provided is added to the container.

Preferably, the method for manufacturing filtered high aspect ratio silver nanowires of the present invention, further comprises: purging a container vapor space in contact with the combination in the container to provide a reduced oxygen gas concentration in the container vapor space; sparging the initial source of silver ions provided with an inert gas to extract entrained oxygen gas from the initial source of silver ions provided and to provide a low oxygen gas concentration in a silver ion vapor space in contact with the initial source of silver ions provided; purging a PVP vapor space in contact with the initial polyvinyl pyrrolidone (PVP) provided to provide a diluted oxygen gas concentration in the PVP vapor space; maintaining the low oxygen gas concentration in the silver ion vapor space and the diluted oxygen gas concentration in the PVP vapor space; and, maintaining the reduced oxygen gas concentration in the container vapor space during addition of the comingled polyvinyl pyrrolidone/source of silver ions, during formation of the growth mixture, and during the hold period.

Preferably, in the method for manufacturing filtered high aspect ratio silver nanowires of the present invention, the total glycol concentration in the container is <0.001 wt % at all times during the method.

Preferably, in the method for manufacturing filtered high aspect ratio silver nanowires of the present invention, the initial polyvinyl pyrrolidone (PVP) and the initial source of silver ions are added to the container at a weight ratio of polyvinyl pyrrolidone (PVP) to silver ions of 4:1 to 10:1 (more preferably, 5:1 to 8:1; most preferably, 6:1 to 7:1).

Preferably, in the method for manufacturing filtered high aspect ratio silver nanowires of the present invention, the initial source of halide ions and the initial source of copper (II) ions are added to the container at a weight ratio of halide ions to copper (II) ions of 1:1 to 5:1 (more preferably, 2:1 to 4:1; most preferably, 2.5:1 to 3.5:1).

Preferably, the method of manufacturing filtered high aspect ratio silver nanowires of the present invention, provides a product, wherein $WF_{Raw}<WF_{Product}$. More preferably, the method of manufacturing high aspect ratio silver nanowires of the present invention, provides a product, wherein $WF_{Raw}<WF_{Product}\geq 0.8$. Still more preferably, the method of manufacturing high aspect ratio silver nanowires of the present invention, provides a product, wherein $WF_{Raw}<WF_{Product}\geq 0.85$. Most preferably, the method of manufacturing high aspect ratio silver nanowires of the present invention, provides a product, wherein $WF_{Raw}<WF_{Product}\geq 0.9$.

Some embodiments of the present invention will now be described in detail in the following Examples.

The water used in the following Examples was obtained using a ThermoScientific Barnstead NANOPure purification system with a 0.2 μm pore size hollow fiber filter positioned downstream of the water purification unit.

Example S1: Halide Ion Subcombination

The halide ion subcombination used herein in certain Examples was prepared by dissolving sodium chloride (0.2104 g; available from Sigma Aldrich) in water (900 mL).

Example S2: Copper (II) Ion Subcombination

The copper (II) ion subcombination used herein in certain Examples was prepared by dissolving copper (II) chloride dihydrate (0.6137 g; available from Sigma Aldrich) in water (900 mL).

Example S3: Reducing Sugar/Copper (II) Ion/Halide Ion Subcombination

The reducing sugar/copper (II) ion/halide ion subcombination used herein in certain Examples was prepared by adding 13.5 g of D-glucose to water (2159 mL) in a flask. Then adding 21.3 mL of the halide ion subcombination prepared according to Example S1 to the flask. Then adding 21.3 mL of the copper (II) ion subcombination prepared according to Example S2 to the flask.

Example S4: Polyvinyl Pyrrolidone (PVP) Subcombination

The polyvinyl pyrrolidone (PVP) subcombination used herein in certain Examples was prepared by adding polyvinyl pyrrolidone (52.2 g; weight average molecular weight of 50,000 g/mol Sokalan® K30 P available from BASF) to water (381 mL) in a flask and then rinsing the transfer equipment with water (203 mL) into the flask.

Example S5: Silver Ion Subcombination

The silver ion subcombination used herein in certain Examples was prepared by adding $AgNO_3$ (12.7 g; ACS reagent grade, ≥99.0% available from Sigma Aldrich) to water (152 mL) in a flask.

Example S6: Comingled Polyvinyl Pyrrolidone/Silver Ion Subcombination

The comingled polyvinyl pyrrolidone/silver ion subcombination used herein in certain Examples was prepared by combining the polyvinyl pyrrolidone (PVP) subcombination prepared according to Example S4 with a silver ion subcombination prepared according to Example S5 in a 1 L conical-bottom container and then sequentially rinsing the flask containing the polyvinyl pyrrolidone (PVP) subcombination and the flask containing the silver ion subcombination with water (102 mL) into the conical-bottom container. The comingled polyvinyl pyrrolidone/silver ion subcombination contained in the conical-bottom container was then gently sparged continuously with nitrogen until transferred to the reactor.

Examples 1 and 2: Preparation of Silver Nanowires

An 8 liter stainless steel pressure reactor outfitted with a three blade propeller style agitator, a temperature control unit with an external resistive heating mantle and an internal cooling tube to facilitate temperature control was used. A reducing sugar/copper (II) ion/halide ion subcombination prepared according to Example S3 was added to the reactor. The transfer equipment was then rinsed with water (152 mL) into the reactor. The reactor was then closed up and the agitator was engaged at 200 rpm. The vapor space in the reactor was then purged with >90 psig nitrogen four times to a pressure of >60 psig with a hold at pressure for three minutes for each purge. The reactor was left with a nitrogen blanket at 16.1 psig following the final purge. The set point for the temperature control unit was then set to 150° C. Once the contents of the reactor reached a temperature of 150° C., $1/5^{th}$ of a comingled polyvinyl pyrrolidone/silver ion subcombination prepared according to Example S6, following a premix period after its preparation, as noted in Table 1, was transferred to the reactor over a 1 minute charge time at a point below the surface of the combination in the reactor to form a creation mixture. Following a delay period of twenty minutes, the remaining $4/5^{th}$ of the comingled polyvinyl pyrrolidone/silver ion subcombination was then transferred to the reactor over a 10 minute feed time at a point below the surface of the creation mixture to form a growth mixture. During the delay period, the set point for the temperature controller was linearly ramped down from 150° C. to 130° C., with the ramp starting 10 minutes into the delay period and ending with the delay period. The growth mixture was then stirred for a hold time as noted in Table 1 to form a raw feed. The raw feed was then cooled to room temperature. The agitator was disengaged. The reactor was then vented to relieve any pressure build up in the vessel. The reactor contents were then transferred as the raw feed to the dynamic filtration device.

TABLE 1

| Ex. # | Premix Period (mins) | Hold Time (hrs) |
|---|---|---|
| 1 | <60 | 8 |
| 2 | <60 | 18 |

Examples 3-4

In each of Examples 3-4, nitric acid was added to the combination in the reactor to adjust the pH of the combination to the pH noted in Table 2. Then, $1/15^{th}$ of a comingled polyvinyl pyrrolidone/silver ion subcombination prepared according to Example S6 following a premix period after its preparation, as noted in Table 2, was transferred to the reactor over a 1 minute charge time at a point below the surface of the combination in the reactor to form a creation mixture. Following a delay period of twenty minutes, the remaining $4/5^{th}$ of the comingled polyvinyl pyrrolidone/silver ion subcombination was then transferred to the reactor over a 10 minute feed time at a point below the surface of the creation mixture to form a growth mixture. During the delay period, the set point for the temperature controller was linearly ramped down from 150° C. to the temperature noted in Table 2, with the ramp starting 10 minutes into the delay period and ending with the delay period. The growth mixture was then stirred for a hold time as noted in Table 2 to form a raw feed. The raw feed was then cooled to room temperature. The agitator was disengaged. The reactor was then vented to relieve any pressure build up in the vessel.

TABLE 2

| Ex. # | pH | Premix Period (mins) | Temp. (° C.) | Hold Time (hrs) |
|---|---|---|---|---|
| 3 | 2.5 | <60 | 130 | 8 |
| 4 | 2.5 | <60 | 130 | 8 |

Examples 5-8: Filtration

In Examples 5-8, the raw feeds containing silver solids including both high aspect ratio silver nanowires and low aspect ratio silver particles prepared according to the synthesis Examples as noted in Table 3 were filtered using an Advantec/MFS model UHP 150 stirred cell filter housing with a filtering area of 162 $cm^2$ and outfitted with a magnetic cylindrical rod impeller. The filter housing was placed on a Mettler model SB32001DR balance/magnetic stirring apparatus. The porous medium used was a 3 μm hydrophilic polycarbonate track-etched (PCTE) filter membrane supported in the bottom of the filter housing. Nitrogen pressure was used to provide the motive force for producing a pressure drop across the porous medium. Nitrogen was supplied to the headspace in the filter housing. The pressure in the headspace was measured using a Cole-Parmer model 68075-16 pressure transducer. The nitrogen fed to the filter housing was passed through a three way ball valve mounted on the top of the filter housing. The three way valve enabled the periodic halting of the nitrogen flow and the periodic relieving of the pressure in the head space of the filter housing to atmosphere. This allowed for a gravity induced reverse flow of filtrate material from the discharge line back into the filter housing up through the filter membrane. The three-way valve was controlled using a Camille process control computer such that every 25 seconds, the nitrogen supply to the filter housing was halted and the filter housing was vented to atmosphere for 5 seconds before reinstituting the nitrogen supply. The raw feed as identified in Table 3 for each of Examples 5-8 was poured into the filter housing. A transport fluid having the composition noted in Table 3 for each of Examples 5-8 was then supplied to the filter housing using a Masterflex model 77800-16 Easy-Load 3 peristaltic pump with digital drive and size 16 C-Flex hose. The volume of transport fluid transferred to the filter housing was manually controlled to maintain a steady level in the filter housing throughout the filtration process. The filtrate exiting the bottom of the filter housing was passed upward through a 4.1 mm ID flexible plastic tube into the top of an open top container. The fluid head in the filtrate tube provided the driving force for the back flow into the filter housing when the head space was periodically opened to atmosphere with the three-way valve. The silver solids in the product filtrate were recovered.

TABLE 3

| Example | Raw Feed | Transport fluid |
|---|---|---|
| 5 | Prod. of Ex. 1 | aqueous solution with 0.15 wt % PVP |
| 6 | Prod. of Ex. 2 | aqueous solution with 1.5 wt % D-glucose |
| 7 | Prod. of Ex. 3 | Purified reaction liquor[38] |
| 8 | Prod. of Ex. 4 | aqueous solution with 140 mM PVP and 25 μM NaCl |

Silver Solids Analysis

The silver solids from Examples 1-8 were analyzed using an FEI Nova NanoSEM field emission gun scanning electron microscope (SEM) using FEI's Automated Image Acquisition (AIA) program. A drop of cleaned dispersion was taken from the UV/Vis cuvette and drop-cast onto a silica wafer coated SEM stub before being dried under vacuum. Backscatter electron images were collected using an FEI Nova NanoSEM field emission gun scanning electron microscope. FEI's Automated Image Acquisition (AIA) program was used to move the stage, focus, and collect images. Eighteen images of each sample were acquired at 6 μm horizontal field width. Semi-automated image analysis using ImageJ software categorized objects as wires versus particles based on an aspect ratio of 3. Wire widths were automatically measured as well as the total area of wires in the images. Particles were tabulated for individual size and total area of particles in the images. ImageJ software was also used to determine the silver nanowire diameter in TABLE 4. The average length of the silver nanowires was observed to exceed 20 μm, based on the SEM images obtained for the diameter analysis.

ImageJ software was used to analyze SEM images of the product silver nanowires from each of Examples 1-8 to provide a relative measure of the silver nanowires having an aspect ratio of >3 in the samples. The statistic used for this measure is the nanowire fraction, $NW_F$, determined according to the following expression:

$$NW_F = NW_A / T_A;$$

wherein $T_A$ is the total surface area of the substrate that is occluded by a given deposited sample of silver solids; and, $NW_A$ is the portion of the total occluded surface area that is attributable to silver nanonowires having an aspect ratio of >3.

TABLE 4

| | Silver Nanowire Diameter (nm) | | | |
|---|---|---|---|---|
| Ex. | Median | Mean | Standard Deviation | $NW_F$ |
| 1 | 33.4 | 37.2 | 16.2 | 0.75 |
| 2 | 30.6 | 35.2 | 15.1 | 0.62 |
| 3 | 37.7 | 39.9 | 12.1 | 0.82 |
| 4 | 35.0 | 39.9 | 17.0 | 0.71 |
| 5 | 32.5 | 36.0 | 20.4 | 0.87 |
| 6 | 29.3 | 32.7 | 15.0 | 0.81 |
| 7 | 33.4 | 35.0 | 10.7 | 0.94 |
| 8 | 36.2 | 36.3 | 7.1 | 0.95 |

We claim:

1. A method for manufacturing filtered high aspect ratio silver nanowires, comprising:

providing a container;

providing an initial volume of water;

providing an initial reducing sugar;

providing an initial polyvinyl pyrrolidone (PVP), wherein the initial polyvinyl pyrrolidone (PVP) provided is dividable into a first part of the initial polyvinyl pyrrolidone (PVP) and a second part of the initial polyvinyl pyrrolidone (PVP);

providing an initial source of copper (II) ions;

providing an initial source of halide ions;

providing an initial source of silver ions, wherein the initial source of silver ions provided is dividable into a first portion of the initial source of silver ions and a second portion of the initial source of silver ions;

adding the initial volume of water, the initial reducing sugar, the initial source of copper (II) ions and the initial source of halide ions to the container to form a combination;

heating the combination to 110 to 160° C.;

comingling the first part of the initial polyvinyl pyrrolidone (PVP) with the first portion of the initial source of silver ions to form a comingled polyvinyl pyrrolidone/source of silver ions;

adding the comingled polyvinyl pyrrolidone/source of silver ions to the combination in the container to form a creation mixture; then, following a delay period, adding to the container the second part of the initial polyvinyl pyrrolidone (PVP) and the second portion of the initial source of silver ions to form a growth mixture;

maintaining the growth mixture at 110 to 160° C. for a hold period of 2 to 30 hours to produce a raw feed wherein a total glycol concentration in the container is <0.001 wt %; wherein the raw feed produced comprise a mother liquor and silver solids; wherein the mother liquor comprises the initial volume of water; and wherein the silver solids in the raw feed include high aspect ratio silver nanowires and low aspect ratio silver particles;

providing a dynamic filtration device, wherein the dynamic filtration device, comprises:

a housing, comprising: a cavity having a first side and a second side;

wherein there is at least one inlet to the first side of the cavity, at least one product outlet from the first side of the cavity and at least one permeate outlet from the second side of the cavity; and, a porous element disposed within the cavity;

a turbulence inducing element disposed within the cavity; and, a pressure source;

wherein the porous element is interposed between the first side of the cavity and the second side of the cavity; wherein the porous element has a plurality of passages that traverse from the first side of the cavity to the second side of the cavity; wherein the plurality of passages are large enough to permit transfer of the mother liquor and low aspect ratio silver particles and small enough to block transfer of the high aspect ratio silver nanowires;

wherein the porous element and the turbulence inducing element cooperate to form a filtration gap, FG; and, wherein at least one of the porous element and the turbulence inducing element is moveable;

providing a transport fluid, wherein the transport fluid comprises a supplemental volume of water and a supplemental polyvinyl pyrrolidone (PVP);

transferring the raw feed to the dynamic filtration device through the at least one inlet to the first side of the cavity;

transferring a volume of the transport fluid to the dynamic filtration device through the at least one inlet to the first side of the cavity;

wherein the filtration gap, FG, is filled by water; wherein the porous element and the turbulence inducing element disposed within the cavity are both in contact with the water;

pressurizing the first side of the cavity using the pressure source resulting in a first side pressure, $FS_P$, in the first side of the cavity; wherein the first side pressure, $FS_P$, is higher than a second side pressure, $SS_P$, in the second side of the cavity, whereby there is created a pressure drop ($PE_\Delta$) across the porous element from the first side of the cavity to the second side of the cavity; wherein the pressure source provides a primary motive force for inducing a flow from the first side of the cavity through the porous element to the second side of the cavity providing a permeate;

moving at least one of the porous element and the turbulence inducing element whereby a shear stress is generated in the water in the filtration gap, FG; wherein the shear stress generated in the water in the filtration gap, FG, operates to reduce fouling of the porous element;

withdrawing the permeate from the at least one permeate outlet from the second side of the cavity, wherein the permeate comprises a second cut of the mother liquor and a second fraction of the silver solids; wherein the second fraction of the silver solids is rich in low aspect ratio silver particles; and, withdrawing a product from the at least one product outlet from the first side of the cavity, wherein the product comprises a first cut of the mother liquor and a first fraction of the silver solids; wherein the first fraction of the silver solids is depleted in low aspect ratio silver particles; and, wherein the shear stress generated in the water in the filtration gap, FG, and the pressure drop ($PE_\Delta$) across the porous element from the first side of the cavity to the second side of the cavity are decoupled.

2. The method of claim 1, wherein the transport fluid further comprises:

a supplemental source of halide ions.

3. The method of claim 2, wherein the transport fluid further comprises:

a supplemental reducing sugar.

4. The method of claim 1, further comprising:

removing the silver solids from the permeate to provide a cleaned permeate; and, recycling the cleaned permeate to the dynamic filtration device through the at least one inlet to the first side of the cavity.

5. The method of claim 4, wherein the silver solids are removed from the permeate using centrifugation to provide the cleaned permeate.

6. The method of claim 4, wherein the transport fluid comprises the cleaned permeate.

7. The method of claim 1, wherein the first part of the initial polyvinyl pyrrolidone (PVP) is 10 to 40 wt % of the initial polyvinyl pyrrolidone (PVP) provided; and, wherein the first portion of the initial source of silver ions is 10 to 40 wt % of the initial source of silver ions provided.

8. The method of claim 7, further comprising:

providing a pH adjusting agent;

adding the pH adjusting agent to the combination before adding the comingled polyvinyl pyrrolidone/source of silver ions; wherein the combination has a pH of 2.0 to 4.0 before adding the comingled polyvinyl pyrrolidone/source of silver ions to the container.

9. The method of claim 7, further comprising:

providing a reducing agent;

adding the reducing agent to the creation mixture.

10. The method of claim 1, further comprising:

purging a container vapor space in contact with the combination in the container to provide a reduced oxygen gas concentration in the container vapor space;

sparging the initial source of silver ions provided with an inert gas to extract entrained oxygen gas from the initial source of silver ions provided and to provide a low oxygen gas concentration in a silver ion vapor space in contact with the initial source of silver ions provided, wherein the low oxygen gas concentration in the silver ion vapor space is less than or equal to 10,000 ppm;

purging a PVP vapor space in contact with the initial polyvinyl pyrrolidone (PVP) provided to provide a diluted oxygen gas concentration in the PVP vapor space, wherein the diluted oxygen gas concentration in the PVP vapor space is less than or equal to 10,000 ppm;

maintaining the low oxygen gas concentration in the silver ion vapor space and the diluted oxygen gas concentration in the PVP vapor space; and, maintaining the reduced oxygen gas concentration in the container vapor space during addition of the comingled polyvinyl pyrrolidone/source of silver ions, during formation of the growth mixture, and during the hold period.

* * * * *